US010408033B2

(12) United States Patent
Ehlig-Economides et al.

(10) Patent No.: US 10,408,033 B2
(45) Date of Patent: Sep. 10, 2019

(54) WELL DESIGN TO ENHANCE HYDROCARBON RECOVERY

(71) Applicant: University of Houston System, Houston, TX (US)

(72) Inventors: Christine Ehlig-Economides, Houston, TX (US); Abbas Ali Daneshy, Katy, TX (US)

(73) Assignee: UNIVERSITY OF HOUSTON SYSTEM, Houston, TX (US)

( * ) Notice: Subject to any disclaimer, the term of this patent is extended or adjusted under 35 U.S.C. 154(b) by 0 days.

(21) Appl. No.: 15/774,310

(22) PCT Filed: Nov. 10, 2016

(86) PCT No.: PCT/US2016/061289

§ 371 (c)(1),
(2) Date: May 8, 2018

(87) PCT Pub. No.: WO2017/083495

PCT Pub. Date: May 18, 2017

(65) Prior Publication Data

US 2019/0003295 A1 Jan. 3, 2019

Related U.S. Application Data

(60) Provisional application No. 62/347,659, filed on Jun. 9, 2016, provisional application No. 62/253,578, filed on Nov. 10, 2015.

(51) Int. Cl.
*E21B 43/30* (2006.01)
*E21B 43/26* (2006.01)
(Continued)

(52) U.S. Cl.
CPC ..... *E21B 43/305* (2013.01); *E21B 43/26* (2013.01); *E21B 47/12* (2013.01); *E21B 43/16* (2013.01)

(58) Field of Classification Search
None
See application file for complete search history.

(56) References Cited

U.S. PATENT DOCUMENTS

2005/0087340 A1 4/2005 Zupanick et al.
2006/0118305 A1* 6/2006 East, Jr. ..... E21B 43/16 166/308.2

(Continued)

OTHER PUBLICATIONS

Zhu, et al., "Simulation of Fracture-to-Fracture Gas Injection in an Oil-Rich Shale", Society of Petroleum Engineers—SPE Annual Technical Conference abd Exhibition held in Houston, Texas, Sep. 28-30, 2015, 18 pages.

(Continued)

*Primary Examiner* — Anuradha Ahuja
(74) *Attorney, Agent, or Firm* — Jackson Walker LLP

(57) ABSTRACT

Enhancing the recovery of unconventional and conventional hydrocarbons is possible by utilizing patterns of wells and hydraulic fractures that are carefully designed to avoid interconnection between injection and production well fractures to allow for both primary production and improved secondary production. Adjacent horizontal wells may be drilled and fractured, with selected wells converted to injection wells after primary production to produce alternating production and injection fractures. In addition, infill horizontal injection wells may be drilled and fractured adjacent to an existing and previously produced multiple transverse fracture horizontal hydrocarbon production well to produce alternating production and injection fractures.

11 Claims, 2 Drawing Sheets

(51) Int. Cl.
*E21B 47/12* (2012.01)
*E21B 43/16* (2006.01)

(56) References Cited

U.S. PATENT DOCUMENTS

| | | | | |
|---|---|---|---|---|
| 2007/0023186 | A1 | 2/2007 | Kaminsky et al. | |
| 2011/0024121 | A1 | 2/2011 | Skeates et al. | |
| 2011/0192601 | A1 | 8/2011 | Bahorich et al. | |
| 2014/0246194 | A1 | 9/2014 | Artus et al. | |
| 2018/0238155 | A1* | 8/2018 | Nguyen | C09K 8/80 |
| 2018/0245443 | A1* | 8/2018 | Nguyen | C09K 8/62 |
| 2018/0252084 | A1* | 9/2018 | Nguyen | C09K 8/80 |

OTHER PUBLICATIONS

The International Preliminary Report on Patentability with the Written Opinion of the International Searching Authority—the Korean Intellectual Property Office for International Application No. PCT/US2016/061289; The International Bureau of WIPO; May 15, 2018, 7 pages.

* cited by examiner

WELL DESIGN TO ENHANCE HYDROCARBON RECOVERY

BACKGROUND

This disclosure pertains to methods and systems for enhancing or improving the recovery of oil and gas from hydrocarbon formations, both conventional and unconventional hydrocarbon formations, and is particularly effective for formations with low permeability.

Tight oil, also referred to as light tight oil (LTO) or shale oil, and gas condensate contain light crude oil present in a petroleum-producing formation that has low permeability. The formation may be shale or tight sandstone, and the fluid flowing in the formation may be in the liquid or gas phase. Unlike more conventional sources in which oil and gas flow naturally and can be pumped to the surface without external stimulation, production of tight oil is considered unconventional and typically requires additional interventions such as hydraulic fracturing. It has been demonstrated that multiple transverse fracture horizontal wells (MTFHWs) can produce oil and gas from formations with lower permeability than was profitable to produce from before the application of this well technology. Originally developed for shale gas, application of this well design has enabled the U.S. industry to increase domestic oil production by about 4.5 million barrels per day in the 5 years from approximately 2010 to 2015.

One problem with the current design of multiple transverse fracture horizontal wells (MTFHW) is that they typically only support primary production. During primary production, reservoir pressure is usually sufficient to flow the oil and gas to the surface. Over the lifetime of a well, the pressure will fall until it is no longer sufficient for profitable recovery of the petroleum product. Secondary production then requires the introduction of pressure support in order to flow the oil and gas to the surface. Often this is done through the injection of fluids such as water, specialty chemicals such as enhanced oil recovery (EOR) polymers, solvent, and/or a gas. The injected fluids increase pressure in the formation again, ideally causing the flow of additional oil and gas to the surface through one or more production wells. However, in MTFHW, attempts to supplement pressure for secondary production by using water injection have been commercially unsuccessful. The likely reason is that injected fluid finds a flow path in the created primary and secondary fractures and bypasses most of the oil and gas remaining in the formation. When the injected fluid enters a producing wellbore, this is known as breakthrough. Early breakthrough is a problem in MTFHW due to the interconnection of fractures and the difficulty in applying pressure across the unfractured matrix where oil and gas remains unproduced.

What is needed, therefore, is a method for improving recovery of hydrocarbons using hydraulic fracturing that allows not only for primary production but also for extended secondary production.

SUMMARY

The present disclosure relates generally to methods and systems for enhancing the recovery of oil and gas, both unconventional and conventional hydrocarbon formations, with particular applicability to formations with low permeability. In particular, the present methods and systems utilize patterns of wells and fractures that are carefully designed to avoid interconnection between propped hydraulic fractures and to allow for primary production and improved secondary production.

Generally, preferred embodiments of this disclosure encompass placement of laterally parallel horizontal wells and transverse fractures. Certain preferred embodiments relate to placement of two infill injection wells around an existing MTFHW. Additional preferred embodiments pertain to placement of three multiple transverse fracture horizontal wells (MTFHWs) in which the central well is later converted to an injection well.

In additional preferred embodiments, the present methods and systems utilize two infill injection wells to be drilled through propped fractures created from an existing multiple transverse fracture horizontal well (MTFHW) that has been producing oil or gas condensate. Each infill well trajectory has the same length and is parallel to the existing MTFHW, on opposite sides of the existing well, and located at a distance of half the half-length of the hydraulic fractures in the existing MTFHW. During drilling of the well through the existing propped fractures, logging while drilling (LWD) will record the position of each existing propped fracture. The well will be cased and cemented, and cement will partially penetrate into existing propped hydraulic fractures. Perforation clusters placed between existing propped hydraulic fractures will enable creation of transverse fractures along the infill wells in positions between the existing transverse fractures created from the existing well and with fracture half-lengths half the length of those in the existing well. In these embodiments, fracture planes for injection wells do not intersect with fracture planes for production wells. The infill injection wells are expected to increase long term hydrocarbon recovery from the existing well to potentially several times what it can produce in its current condition.

In additional certain preferred embodiments of this disclosure, the present methods and systems utilize a minimum of three laterally parallel horizontal wells in which the central horizontal well is located between production wells, and after primary production the central horizontal well is converted to an injection well. Transverse fractures are created along the length of the horizontal wells. In preferred embodiments, fractures for the injection well are positioned on fracture planes that are between fracture planes for the production wells and are longer than the fractures of the production wells. In preferred embodiments, three total horizontal wells are utilized, with the center well being converted to an injection well. In additional preferred embodiments, multiple parallel systems of three parallel horizontal wells are utilized. In these embodiments, fracture planes for injection wells do not intersect with fracture planes for production wells. Embodiments of the present patterned wells are expected to produce at about ½ the primary production rate, but the potential long term oil production is potentially several times what can be produced from current multiple transverse fracture horizontal wells (MTFHW).

DETAILED DESCRIPTION OF PREFERRED EMBODIMENTS

The present disclosure relates to methods and systems for enhancing the recovery of unconventional and conventional hydrocarbons, including tight oil, condensate, and conventional oil, in multiple transverse fracture horizontal wells (MTFHW) that utilize carefully designed patterns of well and fracture placement.

The present methods and systems are illustrated with reference to exemplary scenarios, which are not intended to be limiting. Exemplary scenarios involve a pattern of three (3) horizontal wells, each having multiple transverse fractures. In certain scenarios, a pre-existing well has already been drilled and the improved system relates to the additional of two infill horizontal wells around the existing well. In additional scenarios, three wells are drilled as part of the improved system.

Figure 1A:
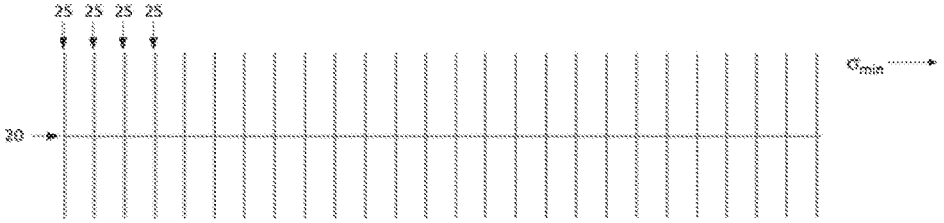
FIG. 1A shows a diagram of a multiple transverse fracture horizontal well (MTFHW) drilled in the minimum stress direction.
Figure 1B:
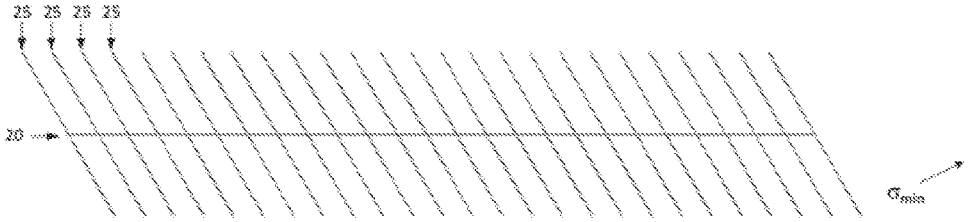
FIG. 1B shows a diagram of a multiple transverse fracture horizontal well (MTFHW) drilled at an angle less than 90 degrees from the minimum stress direction.

In preferred embodiments involving an existing MTFHW, FIG. 1A and FIG. 1B illustrate an existing MTFHW 20 that has been producing oil or gas condensate. FIG. 1A shows a scenario in which the existing well was drilled in a minimum stress direction. FIG. 1B shows a scenario in which wells are not drilled in a minimum stress direction. As seen in FIG. 1A and FIG. 1B, the existing well 20 has associated transverse fractures 25.

Figure 2A:
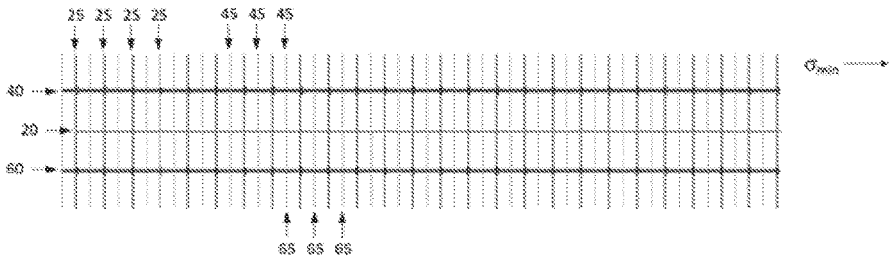
FIG. 2A shows positions for infill injection wells and locations and lengths for transverse fractures in multiple transverse fracture horizontal wells (MTFHWs) drilled in the minimum stress direction, in accordance with exemplary embodiments of the present disclosure.
Figure 2B:
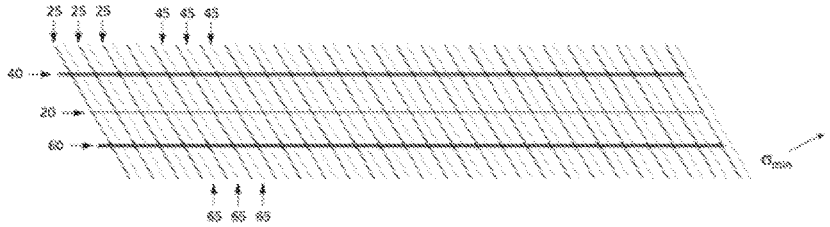
FIG. 2B shows positions for infill injection wells and locations and lengths for transverse fractures in multiple transverse fracture horizontal wells (MTFHWs) drilled at an angle less than 90 degrees from the minimum stress direction, in accordance with exemplary embodiments of the present disclosure.

FIG. 2A and FIG. 2B illustrate exemplary embodiments of a previously drilled MTFHW, labeled 20, and two infill wells labeled 40 and 60. FIG. 2A shows a scenario in which the wells are drilled in a minimum stress direction. FIG. 2B shows a scenario in which wells are not drilled in a minimum stress direction. As seen in FIGS. 2A and 2B, the previously drilled well 20 has associated transverse fractures 25, infill horizontal well 40 has associated transverse fractures 45, and infill horizontal well 60 has associated transverse fractures 65. Selected fractures are labeled in FIGS. 2A and 2B, although the fracture pattern extends along the entire length of the horizontal wells. In these embodiments, fractures 45 and 65 associated with infill wells 40 and 60 are preferably half as long as fractures 25 associated with the existing production well 20. Fractures 25 in the embodiments shown in FIGS. 2A and 2B extend across infill injection horizontal wells 40 and 60, while fractures 45 and 65 need not extend across horizontal well 20.

In the exemplary embodiments shown in FIGS. 2A and 2B, the three horizontal wells 20, 40, and 60 optionally may be produced in primary production. After primary production is completed fluid is injected in the central horizontal well 20 to provide pressure support and displace additional oil and gas to the infill production wells. Thus, during secondary production, there is an alternating pattern of production fractures, 45 or 65, adjacent to injection fractures 25, that extend along the length of the horizontal wells.

In the embodiment shown in FIGS. 2A and 2B, it is important for the fractures to be positioned so that there is no unintended intersection between fractures 25 and either fractures 45 or fractures 65. While drilling the infill injection horizontal wells 40 and 60, measurements while drilling will detect the locations of propped fractures created from the existing MTFHW 20.

It is important that the outside casings of infill injection horizontal wells 40 and 60 are cemented with the cement penetrating into fractures 25 associated with horizontal well 20. This is essential, to ensure that the annulus between the formation and the well casing is sealed by cement and that there is no possibility for hydraulic connection or hydraulic communication between fractures 25 and horizontal wells 40 and 60 or their fractures 45 and 65.

Perforation clusters are positioned between locations of propped fractures created from the existing MTFHW that were identified by measurements while drilling.

During hydraulic fracturing, stress shadowing is expected to guide fractures away from intersecting existing fractures on either side of fracture, with the propagation path expected based on known tensile fracture propagation behavior.

Fractures 45 and 65 associated with the infill injection wells can intersect. Fractures 25 and 45 and fractures 25 and 65 must not intersect. During hydraulic fracturing in wells 40 and 60, observation of pressure behavior in the production well 20 will indicate unintended intersection between fractures 25 and 45 or fractures 25 and 65. Identification of any fracture intersecting a production well fracture will be limited to the perforation cluster locations being injected at the time the pressure observation occurs Location of unintended intersection between injection and production well fractures can also be determined by injection fluid entry in a production log survey conducted in the production well after the start of injection and production.

Any pair of production and injection well fractures showing connection by pressure monitoring or produced injection fluid in a production log survey is plugged using known procedures for plugging off unwanted fluid production in MTFHW completions. The flow of injection fluid breakthrough is then diverted through unpropped secondary fractures to other flow paths, thereby increasing hydrocarbon recovery from existing hydrocarbon production. Unpropped secondary fractures are a product of the hydraulic fracturing process and result in additional heterogeneity that may be problematic to a displacement process without this diversion approach.

Each injection fracture has two wings with productive height equal to the formation thickness and productive length equal to the fracture half-length, which is half the production fracture half-length. Each injection fracture wing is paired with half of one production fracture wing on each side. Paired wings are parallel planes, and the fluid injected in the infill injection-well fracture planes displaces hydrocarbons to the production-well fracture planes.

Plane to plane fluid displacement is a highly efficient process provided the formation is homogeneous. Formation inhomogeneity due to secondary natural fractures opened or reopened during hydraulic fracturing and/or stratigraphic facies or diagenesis may result in early breakthrough of the injection fluid into a production well fracture followed by high rate flow through the created or existing flow path. Automated processes serve to divert flow in breakthrough flow channels to other flow paths, thereby increasing the displacement recovery efficiency.

It is important for the fractures to be positioned so that there is no unintended intersection between fractures 25 and either fractures 45 or fractures 65. Fractures 45 and 65 can intersect. All horizontal wells 20, 40, and 60 optionally may be used for primary production initially. Secondary production can be either by converting central horizontal well 20 to an injection well with wells 40 and 60 kept on production, or converting infill wells 40 and 60 to injection wells with well 20 kept on production.

The horizontal length of the wells is optional and can be selected based on the preference of the operator. For a 128 acre pattern, this preferably includes 5 patterns with 3 wells in each pattern. One (1) mile wells are preferably drilled with 264 ft. of spacing between wells. Horizontal wells can be drilled in any direction, but fracture planes will be perpendicular to the minimum in-situ principal stress direction. Fractures from different production wells can intersect each other, as can fractures from different injection wells. However, adequate completion steps must ensure no direct communication between fractures associated with injection and production wells. The 3 well pattern can be replicated any number of times, but fractures in adjacent patterns must not touch fractures from an existing well unless both wells are production wells, or both wells are injection wells.

EXAMPLE 1

Production Rate Sensitivity

Table 1 below shows the calculated production rate sensitivity to a pressure drop between an injection well on an injection plane and production well on a production plane, for one-half of a fracture to fracture plane pair, for various formation permeabilities (k, measured in millidarcy (md)). An increased pressure drop results in an increased production rate. The calculation uses the Buckley-Leverett formulation for linear flow. The flow area is for one-half of a fracture to fracture plane pair. For the 128 acre 3 well pattern with wells drilled in the minimum stress direction, each half fracture length is 264 ft. The calculation assumes the formation height is 100 ft., giving a flow area of 26,400 sq. ft.

TABLE 1

| | Initial Oil Rate, bbl/day | | | |
|---|---|---|---|---|
| Pressure drop, psi | k = 0.1 md | k = 0.01 md | k = 0.001 md | k = 0.0001 md |
| 100 | 1.488 | 0.1488 | 0.0149 | 0.00149 |
| 500 | 7.438 | 0.7438 | 0.0744 | 0.00744 |
| 1000 | 14.876 | 1.4876 | 0.1488 | 0.01488 |

There are a total of 204 half fractures to half fracture plane pairs. Therefore, the total rate for the pattern is 204 times each of the numbers in Table 1. Table 2 below shows the production rate sensitivities to a pressure drop for the whole area covered by one embodiment.

TABLE 2

| | Initial Oil Rate, bbl/day | | | |
|---|---|---|---|---|
| Pressure drop, psi | k = 0.1 md | k = 0.01 md | k = 0.001 md | k = 0.0001 md |
| 100 | 303.5 | 30.3 | 3.0 | 0.30 |
| 500 | 1517.4 | 151.7 | 15.2 | 1.52 |
| 1000 | 3034.8 | 303.5 | 30.3 | 3.03 |

This demonstrates that greater pressure drops between fracture plane pairs in formations having relatively high permeability (0.1 md) can produce production rates as high as 3035 bbl/day per embodiment (well pattern). For a conventional reservoir with higher permeability, fewer hydraulic fractures would be created. In general, the number of fractures to create is a design question requiring consideration of the project economics.

EXAMPLE 2

Secondary Production Recovery Enhancement

In this example, a 100 ft. distance exists between fracture planes. This means that each well has fractures 200 ft. apart and the distance between adjacent injection and production fractures is 100 ft. The total pore volume for the region between fracture planes associated with this 2-plane pattern can be calculated by multiplying the total volume of the region by the porosity. Thus, for example, if the fracture plane pair has a total volume circumscribed by 100 ft. (between fracture planes), 100 ft. (fracture height, h), and 264 ft. (fracture half length, $x_f$) and the porosity ($\phi$) is 0.08, then the total pore volume for this fracture plane pair can be calculated as:

$$hx_fx_s\phi=100*264*100*0.08=211{,}000\ ft^3$$

If water saturation for this fracture plane region is 0.6, then this region could contain oil in the amount calculated as:

$$211{,}000\ ft^3*0.4/5.615\ bbl/ft^3=15{,}000\ bbl$$

If it is possible to displace 25% of this amount, this is a reserve of 3,750 bbl. If primary production produces 2%, the remaining reserve for waterflooding for this particular fracture plane pair region is 3,450 bbl.

In this example, the total area is covered by three wells, each having 26 fractures, which produces a total of 204 one-half fracture plane pair regions. Using the calculations above, this would result in 0.7 million bbl for the region covered by these three wells. The primary production, at 2%, can also be calculated considering the total dimensions of the region covered by the wells, or 5100 ft. (51×100 ft. fracture pairs), 100 ft., and 1056 ft. (4 rows of one-half fracture plane pairs of 264 ft.), as well as porosity of 0.08 and water saturation of 0.6, as shown below:

$$0.02*5100*100*1056*0.08*0.4/5.615=61{,}000\ bbl$$

Thus, the ability to recover an additional 0.7 million bbl represents secondary recovery production enhancement of 1100%.

If it is assumed that each well in the three well pattern costs $5 million, then at $50/bbl, it would take 100,000 bbl to pay for each well. This would likely need to occur during the primary production phase, when all wells are used as production wells. Primary production choked to 500 STB/d per outer well and 1000 STB/d for the center well would reach 100,000 STB in 50 days. A simulation using commercial software shows that these production rates are easily achieved for permeability of 0.1 md.

For embodiments using two injection wells, it would take 200,000 bbl to pay for both wells. Simulated production rates using estimated permeability parameters indicate how long it would take to produce 200,000 bbl. For example, to produce this amount in one year would require an average daily oil production rate of 200,000/365=550 bbl/d.

What is claimed is:

1. A method for enhancing recovery of hydrocarbons from a formation having an existing multiple transverse fracture horizontal well (MTFHW) and existing primary transverse fractures associated with the multiple transverse fracture horizontal well (MTFHW), comprising:

drilling a first infill injection horizontal well and a second infill injection horizontal well, wherein the existing multiple transverse fracture horizontal well (MTFHW) is located between the first and second infill injection horizontal wells, wherein the existing multiple transverse fracture horizontal well (MTFHW) is separated from the first and second infill injection horizontal wells by a distance of half of a half-length of the existing primary transverse fractures, and wherein the first infill injection horizontal well, the existing multiple transverse fracture horizontal well (MTFHW), and the second infill injection horizontal well are substantially laterally parallel;

determining locations of the existing primary transverse fractures associated with the existing multiple transverse fracture horizontal well (MTFHW) that intersect with the first and second infill injection horizontal wells;

casing and cementing the first and second infill injection horizontal wells, wherein cement penetrates into the existing primary transverse fractures intersected by the first and second infill injection horizontal wells to seal an annulus between a casing and a drilled hole diameter of each of the first and second infill injection horizontal wells and to prevent hydraulic communication between the first and second infill injection horizontal wells and the existing primary transverse fractures;

hydraulically fracturing the first and second infill injection horizontal wells at perforation cluster locations centered between the existing primary transverse fractures that intersect with the first and second infill injection horizontal wells to produce first injection fractures and second injection fractures;

monitoring pressure in the existing multiple transverse fracture horizontal well (MTFHW) during the hydraulic fracturing of the first and second infill injection horizontal wells to detect direct intersection between first and second injection fractures and existing primary transverse fractures;

plugging detected direct intersections between the first and second injection fractures and the existing primary transverse fractures;

injecting secondary recovery fluids into the first and second infill injection horizontal wells; and producing secondary hydrocarbons from the existing multiple transverse fracture horizontal well (MTFHW).

2. The method of claim 1, further comprising:

performing a production log survey after the steps of injecting secondary recovery fluids and producing secondary hydrocarbons to identify existing transverse fractures producing injection fluid breakthrough;

plugging the existing transverse fractures producing injection fluid breakthrough; and diverting flow of injection fluid breakthrough through unpropped secondary fractures to other flow paths, thereby increasing hydrocarbon recovery from existing hydrocarbon production.

3. The method of claim 1, further comprising a step of producing hydrocarbons from the existing multiple transverse fracture horizontal well (MTFHW) before the step of drilling the first infill injection horizontal well and the second infill injection horizontal well.

4. The method of claim 1, further comprising a step of producing primary hydrocarbons from one or both of the first infill injection horizontal well and second infill injection horizontal well after the step of hydraulically fracturing the first and second infill injection horizontal wells.

5. An apparatus for recovering hydrocarbons from a formation, comprising:

an existing multiple transverse fracture horizontal well (MTFHW) having associated existing primary transverse fractures;

a first infill injection horizontal well having a casing, a cemented annulus, a drilled hole diameter, and associated first injection fractures, wherein the first injection fractures are half as long as the existing primary transverse fractures; and a second infill injection horizontal well having a casing, a cemented annulus, a drilled hole diameter, and associated second injection fractures, wherein the second injection fractures are half as long as the existing primary transverse fractures, wherein the existing multiple transverse fracture horizontal well (MTFHW) is located between the first and second infill injection horizontal wells, wherein the existing multiple transverse fracture horizontal well (MTFHW) is separated from the first and second infill injection horizontal wells by a distance of half of a half-length of the existing primary transverse fractures, wherein the first infill injection horizontal well, the existing multiple transverse fracture horizontal well (MTFHW), and the second infill injection horizontal well are substantially laterally parallel, wherein the first and second injection fractures are centered between the existing primary transverse fractures that intersect with the first and second infill injection horizontal wells, and wherein cement penetrates into the existing primary transverse fractures that intersect with the first and second infill injection horizontal wells to seal the cemented annulus between the casing and the drilled hole diameter of each of the first and second infill injection horizontal wells.

6. A method for enhancing recovery of oil from a formation, comprising:

drilling and cementing a central horizontal well in a well direction that is not parallel to a maximum horizontal stress direction of the formation;

fracturing the central horizontal well to provide central well transverse fractures;

drilling a first horizontal well and a second horizontal well, wherein the central horizontal well is located between the first and second horizontal wells, wherein the central horizontal well is separated from each of the first and second horizontal wells by a specified distance, wherein the first horizontal well, the central horizontal well, and the second horizontal well are substantially laterally parallel, wherein the central well transverse fractures have half-lengths substantially equal to twice the specified distance;

detecting locations of central well transverse fractures and cementing detected fractures to prevent hydraulic contact with the central well transverse fractures;

casing and cementing the first horizontal well and second horizontal well, wherein cement penetrates into the central well transverse fractures intersected by the first horizontal well and second horizontal well to seal an annulus between a casing and a drilled hole diameter of each of the first and second horizontal wells and to prevent hydraulic communication between the first and second horizontal wells and the central well transverse fractures;

fracturing the first horizontal well and the second horizontal well to provide first well transverse fractures and second well transverse fractures, wherein the first well transverse fractures and the second well transverse fractures are positioned such that each first and second well transverse fracture is located between two adjacent central well transverse fractures, wherein the first well transverse fractures and the second well transverse fractures have half-lengths substantially equal to half the length of the half-lengths of the central well transverse fractures, and wherein the central well fractures do not intersect the first well transverse fractures or the second well transverse fractures;

monitoring pressure in the central horizontal well during hydraulic fracturing of the first horizontal well and the second horizontal well to detect unintended intersection between first well transverse fractures or second well transverse fractures with central well transverse fractures; and plugging detected intersections between first well transverse fractures or second well transverse fractures and central well transverse fractures.

7. The method of claim 6, further comprising a step of producing primary oil from one or more of the central horizontal well, the first horizontal well, and the second horizontal well.

8. The method of claim 6, further comprising:

converting the central horizontal well to an injection well;

injecting secondary recovery fluids into the injection well; and producing secondary oil from the first horizontal well and the second horizontal well.

9. The method of claim 8, further comprising:

performing a production log survey after the steps of injecting secondary recovery fluids and producing secondary oil to identify existing transverse fractures producing injection fluid breakthrough;

plugging the existing transverse fractures producing injection fluid breakthrough; and diverting flow of injection fluid breakthrough through unpropped secondary fractures to other flow paths, thereby increasing hydrocarbon recovery from existing hydrocarbon production.

10. The method of claim 6, further comprising:

converting the first horizontal well and the second horizontal well to injection wells;

injecting secondary recovery fluids into the injection wells; and producing secondary oil from the central horizontal well.

11. The method of claim 10, further comprising:

performing a production log survey after the steps of injecting secondary recovery fluids and producing secondary oil to identify existing transverse fractures producing injection fluid breakthrough;

plugging the existing transverse fractures producing injection fluid breakthrough; and diverting flow of injection fluid breakthrough through unpropped secondary fractures to other flow paths, thereby increasing hydrocarbon recovery from existing hydrocarbon production.

* * * * *